US006257911B1

(12) United States Patent
Shelby et al.

(10) Patent No.: US 6,257,911 B1
(45) Date of Patent: Jul. 10, 2001

(54) LOW INSERTION FORCE CONNECTOR WITH WIPE

(76) Inventors: Frank S. Shelby, 1211 E. Dove, Southlake, TX (US) 76092; James B. Goodman, 4750 Pear Ridge Dr. No. 9301, Dallas, TX (US) 75287

( * ) Notice: Subject to any disclaimer, the term of this patent is extended or adjusted under 35 U.S.C. 154(b) by 0 days.

(21) Appl. No.: 09/437,647

(22) Filed: Nov. 10, 1999

(51) Int. Cl.[7] ..... H01R 11/22
(52) U.S. Cl. ..... 439/268
(58) Field of Search ..... 439/268, 267, 439/269.1, 266, 265

(56) References Cited

U.S. PATENT DOCUMENTS

| | | | |
|---|---|---|---|
| 3,171,183 | 3/1965 | Johnston | 24/230 |
| 4,334,193 | 6/1982 | Gordy et al. | 324/437 |
| 4,542,950 | 9/1985 | Gillett et al. . | |
| 4,591,222 | 5/1986 | Shaffer . | |
| 4,655,526 | 4/1987 | Shaffer . | |
| 4,684,193 | 8/1987 | Havel | 439/259 |
| 4,773,873 | 9/1988 | Hillis | 439/260 |
| 4,867,697 | 9/1989 | Borges | 439/265 |
| 5,504,435 | 4/1996 | Perego | 324/755 |
| 5,601,443 | 2/1997 | Stinsky et al. | 439/263 |

*Primary Examiner*—Tulsidas Patel
*Assistant Examiner*—Javaid Nasri

(74) *Attorney, Agent, or Firm*—David Fink

(57) ABSTRACT

A low insertion force connector contact assembly (122) has two contacts (136, 144) which are separated by insulation (143) from one another to provide separate circuit paths for separately engaging a mating contact (166) of a mating connector (22) in a Kelvin test configuration. The contact (144) engages the mating contact (166) of the mating connector (22) for applying current and voltage to the mating contact (166). The contact (136) engages the mating contact (166) for measuring the voltages of the mating contact (166). Preferably, the contact (144) is a spring biased plunger which is urged from a retracted position to an extended position. In the extended position, the contact (144) pushes the contact (136) aside of a position for engaging the mating contact (166). When the mating connector (22) is being engaged with the connector assembly (122), the mating contact (166) pushes the spring biased, plunger contact (144) from the extended position to the retracted position, releasing the contact (136) to engage with mating contact (166) with a wipe during a makeup stroke in which the mating contact (166) is engaged within the contact assembly (122). This type of contact assembly connection may be used with mating contacts (166) of various cross sections, such edge connector lands, and square, rectangular and round leads. In a production testing environment, the mating contacts (166) may be cleaned by spraying with a solvent or a discharge of air when being inserted into a connector contact assembly (202).

6 Claims, 8 Drawing Sheets

LOW INSERTION FORCE CONNECTOR WITH WIPE

TECHNICAL FIELD OF THE INVENTION

The present invention is related in general to low insertion force electrical connectors, and, in particular, to a low insertion force electrical connector having a wipe feature when the connectors are mated.

BACKGROUND OF THE INVENTION

Prior art connectors have been provided for electrically connecting two electric circuits, such as those found on circuit boards. One example is a pin-type connector and another example is an edge connector of printed circuit boards. Typically, an interference fit between the contacts of mating connectors provides a scraping action which wipes clean the surfaces of the mating contacts. However, when a large number of contacts are mated between two connectors with wiping engagement, the forces required to mate the two connectors often becomes quite large. Another problem with connectors having a wipe feature is that a full-stroke contact wipe causes excessive wear to the mating surfaces of the contacts. Some connector contacts are typically rated for a limited number of wipes, such as some gold contacts which are rated for only a few cycles. Other prior art connectors have been provided with a low insertion force feature in which a cam member is spring biased to separate two spaced-apart contacts with a clearance for passing the contact of a mating connector. Insertion of the mating connector into the low insertion force connector pushes the cam member against the bias spring, allowing the spaced-apart contacts to move toward one another and to engage the contacts of the connector being mated. These prior art low insertion force connectors have only one contact per mating connector contact, and not two separately insulated contacts.

Another problem with prior art connectors occurs in those used for testing circuits using a high voltage potential, often called "High-Pot Testing." The high potential voltages applied in such tests often result in a large driving current being applied across the mating surfaces of the contacts. In some circumstances, a Kelvin test configuration may be used in which pairs of contacts are used for each connection to a unit under test, wherein one contact is used for driving the test current, or as the high voltage contact, and a second contact is used to take test measurements. When Kelvin test configurations are used, the electrical connections between mating leads are typically maximized by using wiping engagements and high contact pressures when the test contact connections are mated in order to reduce the voltage potential drop across the interface of the test contacts. However, with increasing miniaturization of circuitry, Kelvin test configurations have become increasingly difficult to implement due to significant decreases in contact spacings. With decreased contact spacings and further reductions in sizes of the contacts to fit within such spacings, the wear ratings of such contacts are rated for even fewer cycles of mating and breaking connections, especially if a full length wipe is used for the contacts during connector mating.

SUMMARY OF THE INVENTION

A low insertion force connector has contact assemblies which provide a limited wipe during the insertion stroke of a mating contact, and two separate circuit paths with each of the contacts of the mating unit in a Kelvin test arrangement. The contact assemblies include a plunger which is moveably mounted within a housing and has an exterior periphery which defines a cam surface and a contact surface. The plunger is moveably disposed within the housing for engaging the mating unit and moving from an extended position to a retracted position. The contact assemblies further include a bias member which biases the plunger into the extended position, and a contact member having a biasing portion, a contact portion and a mating periphery which is mounted to the housing and moved by the plunger to a position which is spaced apart from a contact position located adjacent to an aperture in the housing. An insulator extends between the biasing portion of the contact member and the plunger for electrically isolating the contact member from the plunger when the plunger is disposed in the retracted position. Insertion of the mating unit into the aperture engages the mating unit with the plunger, moving the plunger from the extended position to the retracted position with the plunger electrically coupled to the contact of the mating unit in a first electrical connection providing a first circuit path, and the contact portion of the contact member also engaging the contact of the mating unit in a second electrical connection providing a second circuit path. In a production testing environment, the mating contacts may be cleaned by spraying with a solvent or a discharge of air when being inserted into a connector contact assembly.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
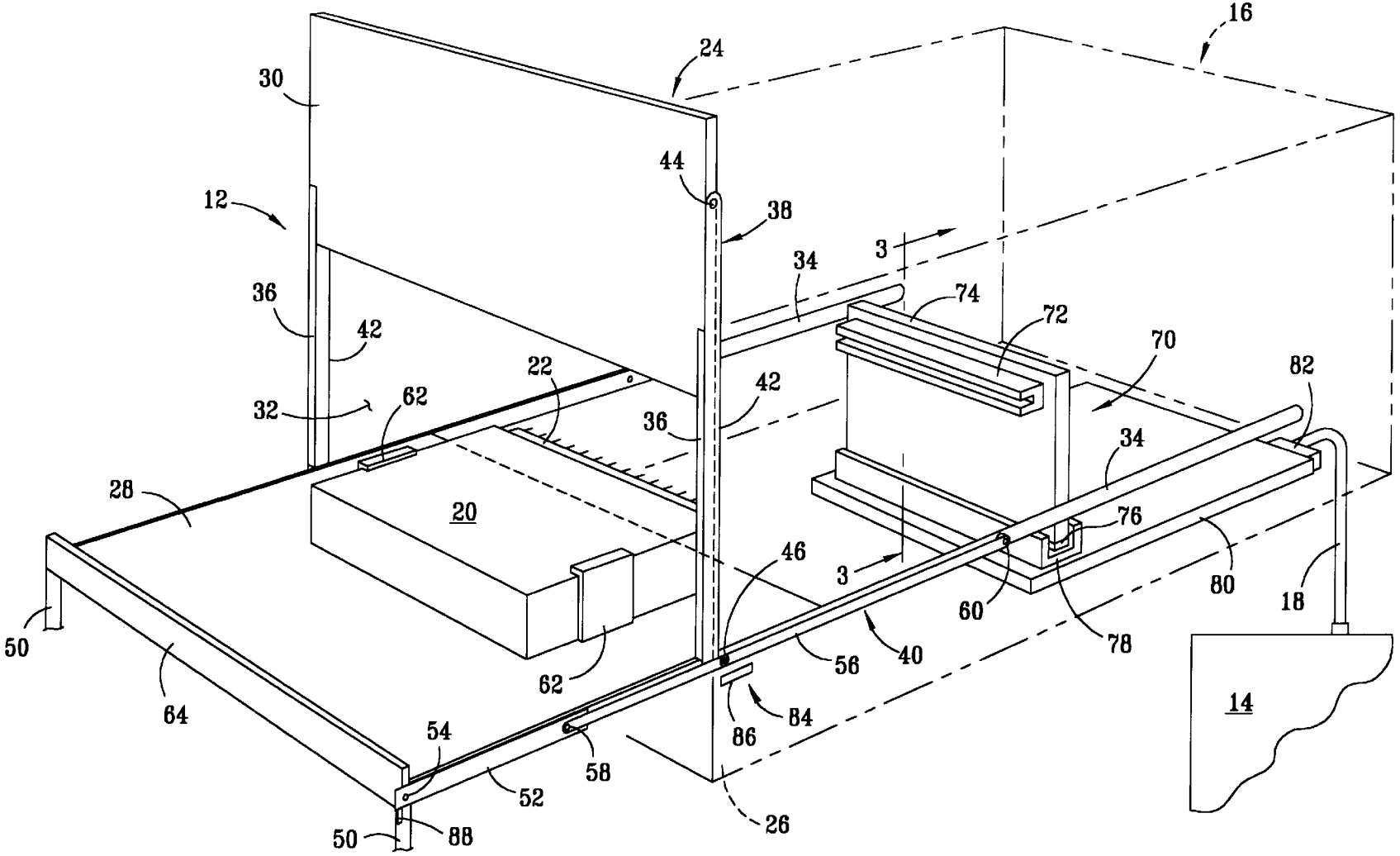
FIG. 1 is a perspective view of a test station having an adapter unit which includes a low insertion force connector made according to the present invention, with the adaptor unit shown in an open position for loading a unit under test into the test station.

FIG. 1 is a perspective view of a test station 12 made according to the present invention. The test station 12 includes a test unit 14 and an adaptor unit 16 which are connected by a cabling connection 18. In some embodiments, the adaptor unit 16 may be rigidly mounted to the test unit 14. A unit under test ("UUT") 20 includes a connector 22. The UUT 20 is mounted within an enclosure 24 of the adaptor unit 16. The enclosure 24 includes a housing 26 (shown in phantom) having a drawer 28 and a cover 30. The cover 30 encloses a front opening 32 of the enclosure 24. Two mounting rails 34 are mounted on opposite sides of the housing 26 and extend in parallel in a horizontal plane. Two slide assemblies are rigidly mounted to opposite sides of the drawer 28 and slidably engage the mounting rails 34 to slidably mount the drawer 28 to the housing 26 such that the drawer may slide outward of the housing 26 in a horizontal plane. Two vertically disposed tracks 36 are mounted to the housing for slidably mounting the cover 30 to the housing 26. The cover 30 slides upward from the housing 26, preferably in a vertical plane.

A cover operating assembly 38 and a drawer operating assembly 40 are interlinked such that the drawer 40 and the cover 38 are operated simultaneously. The cover operating assembly 38 includes two linkages 42 which are mounted on the opposite sides of the cover 30 and which extend in parallel. Each of the linkages 42 have ends which are pivotally mounted to an upper portion of the cover 30 at pivot points 44, and opposite ends which are pivotally mounted to the opposite sides of an inward portion of the drawer 28 at pivot points 46. Movement of the drawer 28 outward from within the housing 26 of the enclosure 24 operates the linkages 42 such that the cover 30 will move upward within the tracks 36 to allow access through the opening 32 and into to the interior of the housing 26. Similarly, movement of the drawer 28 into the housing 26 will move the linkages 42 such that the cover 30 is moved downward within the tracks 36 to enclose the opening 32.

The drawer operating assembly 40 includes two halves, which extend on opposite sides of the drawer 28. Each of the two halves includes a handle 50 which is rigidly mounted in an L-type configuration to a respective linkage 52. The two handles 50 and linkages 52 are pivotally mounted to the forward end of opposite respective sides of the drawer 28 at pivot points 54. The two linkages 52 are mounted on opposite ends from respective ones of the two pivot points 54 and the handles 50 to linkages 56 at pivot points 58. The pivot points 58 are free floating, in that they are not disposed in a fixed relation to the housing 26, but rather are free to move relative to the housing 26 about respective arcs which preferably each have a continuous radius relative to pivot points 60 at which the two linkages 56 are pivotally mounted to the housing 26, respectively. Further included on the drawer 28 is a fixture 62 for securing the UUT 20 to an upper surface of the drawer 28. The drawer 28 further includes a front portion 64 which extends upward to provide a forward lip which engages a lower portion of the cover 30.

Disposed interiorly within the housing 26 is a connection assembly 70. The connection assembly 70 includes a low insertion force connector 72. The low insertion force connector 72 is mounted to a printed circuit board 74, which extends in vertical relation to the housing 26. The printed circuit board 74 has a lower end which defines an edge connector 76. The edge connector 76 fits within a low insertion force edge connector 78, which is preferably made according to the present invention. The connector 78 is mounted to a printed circuit board 80. A rearwardly disposed connector 82 is also mounted to the board 80. The connector 82 is provided for mating to the cabling 18 connecting between the adaptor unit 16 and the test unit 14. The connection assembly 70 is provided such that the connector 72 and the printed circuit board 74 may be replaced with a different connector and printed circuit board for mating with other units under test with connectors of different geometrical configurations from that of the connector 22. Thus, the adaptor unit 16 may be utilized to test a wide variety of units under test having different connector configurations.

The adaptor unit 16 of the present invention further includes a safety switch 84 which grounds power leads of the adapter 28 when the drawer 28 and the cover 30 are in outward positions, such that the opening 32 into the enclosure 24 is open to expose the power contacts of the test station 12. The safety switch 84 preferably includes a reed switch 86 and a magnetic actuator 88. The actuator 88 is preferably a permanent magnet mounted to the handle 50.

Figure 2:
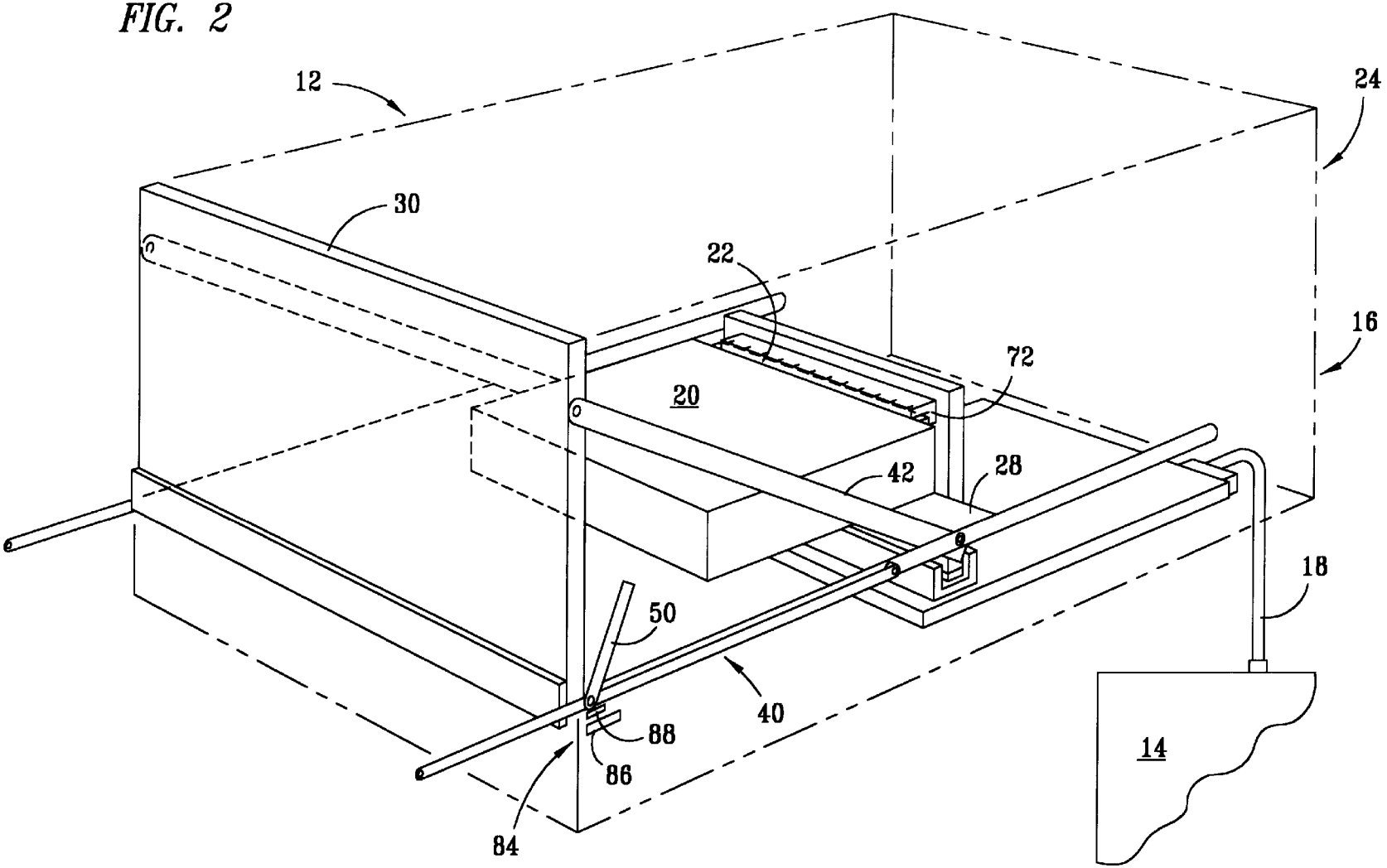
FIG. 2 is perspective view of the test station, showing the adaptor unit in a closed position to secure the unit under test interiorly within the adaptor unit and to connected the unit under test to the low insertion force connector.

FIG. 2 is a perspective view of the test station 12 after the adaptor unit 16 has been operated to move the drawer 28 into the housing 26 of the enclosure 24, and the cover 30 has been moved downward to cover the opening 32. The drawer 28 and the UUT 20 have been moved inward such that the connector 22 has engaged the connector 72. Additionally, a magnetic actuator 88 has been moved adjacent to a reed switch 86 such that the safety switch 84 is no longer disposed in a grounding position, in which power connections of the connection assembly 70 and the adapter unit 16 are grounded. The safety switch 84 provides an important safety lock-out device to prevent electric shock hazards when the test station 12 is utilized for High-Pot Testing of various UUTs. The drawer operating assembly 40 has been moved to the inward position, closing the drawer 28, which causes the cover operating assembly 38 to move the cover 30 downward to enclose the UUT 20 within the enclosure 24.

Figure 3:
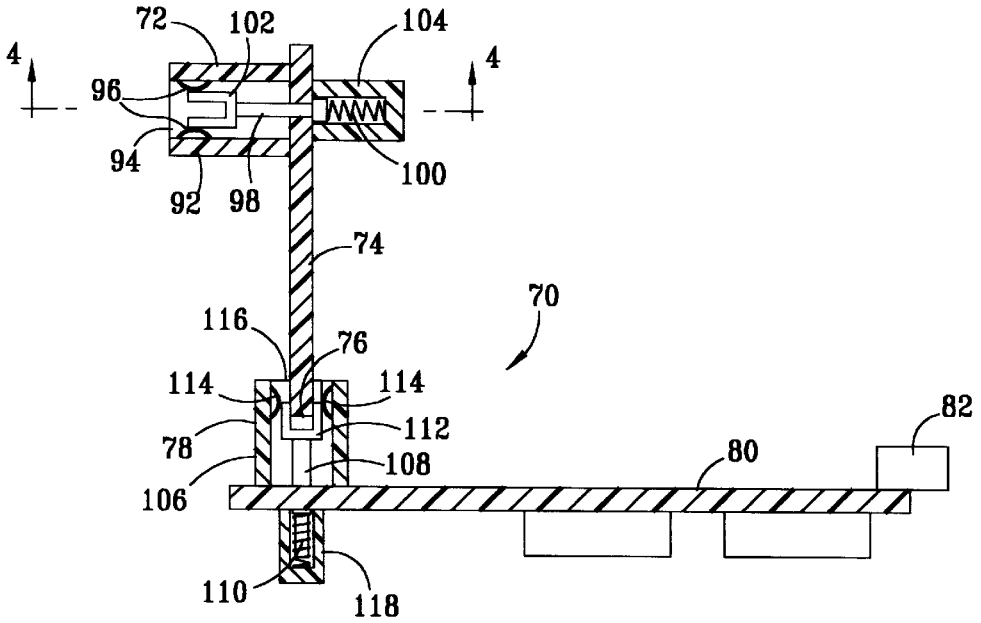
FIG. 3 is a sectional view of a connection assembly of the adaptor unit of the test station, taken along section line 3—3 of FIG. 1.

FIG. 3 is a sectional view of the connection assembly 70, taken along section line 3—3 of FIG. 1. The connector assembly 70 includes the connector 72 and the printed circuit board 74, with the edge connector 76 of the printed circuit board 74 fitting within the connector 78 in a vertical mounting alignment. The connector 72 then extends forward of the board 74 in a horizontal mounting alignment for engaging the UUT 20 (shown in FIG. 2). The rearward end of the printed circuit board 80 has a connector 82. The connector 72 has a housing 92 having a forward opening aperture 94. Spaced apart on vertically opposite sides of the aperture 94 are two contacts 96. A second housing 104 is mounted to an opposite side of the board 74 from the housing 92. A bias member 100, preferably provided by a coil spring, is disposed within the housing 104 for urging a plunger 98 from within the housing 104 and into a forward position in the housing 92. A moveable cam member 102 is mounted to the forward end of the plunger 98 and preferably has a U-shaped cross-section. The bias member 100 urges the plunger 98 forward, pushing the moveable cam member 100 between the two contacts 96. Insertion of a mating portion of the connector 22 of the UUT 20, as shown in FIG. 2, into the connector 72 pushes the cam member 102 and the plunger 98 rearward against the bias member 100, removing the cam member 102 from between the contacts 96 which allows the contacts 96 to engage the contacts of the connector 22, preferably with a wiping engagement for the last thirty thousandths of an inch (0.030 in.).

The connection assembly 70 further includes the connector 78, which preferably is identical to the connector 72. The connector 78 is configured for mating with the edge connector 76 of the printed circuit board 74, with the circuit board 74 being disposed perpendicular to the board 80. The connector 78 has two contacts 114 which are spaced apart on opposite sides of an opening 116 in the upper end of a housing 106 of the connector 78. A second housing 118 is mounted to an opposite side of the board 80 from the housing 106. A bias member 110, preferably a coil spring, is disposed within the housing 106 for urging a plunger 108 from within the housing 118 and into a forward position in the housing 106. A moveable cam member 112 is mounted to the forward end of the plunger 108 and preferably has a U-shaped cross-section. The bias member 110 urges the plunger 108 forward, pushing the moveable cam member 112 between the two contacts 114 and spacing the two contacts 114 apart to prevent wiping of the edge connector 76 of the board 74 during an initial portion of a stroke for inserting the connector 76 into the connector 78. Engagement of the edge connector 76 of the board 74 pushes the moveable cam member 112 and the plunger 108 rearward, allowing the two contacts to engage the contacts of the edge connector 76, preferably with a wiping engagement for the last thirty thousandths of an inch (0.030 in.) of the insertion stroke.

Figure 4:
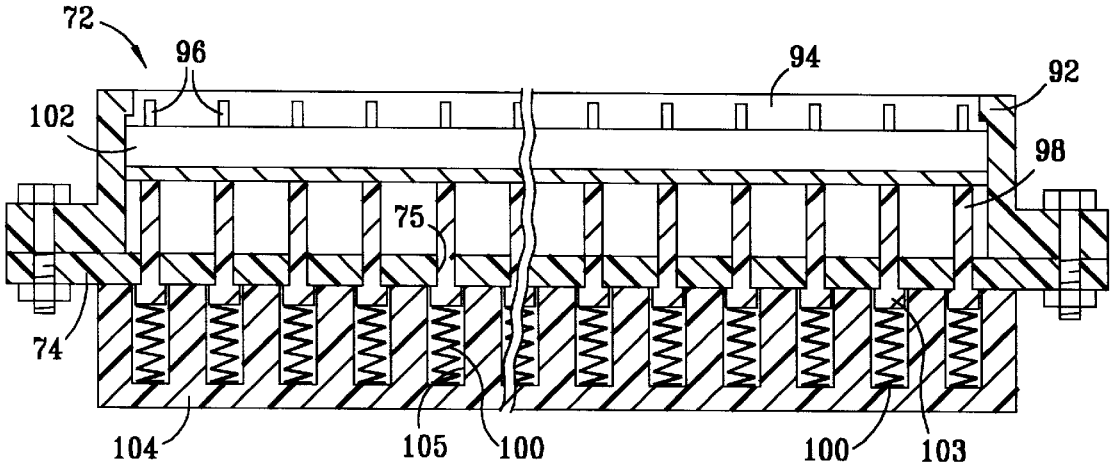
FIG. 4 is a sectional view of a connector of the connection assembly, taken along section line 4—4 of FIG. 3.

FIG. 4 is a sectional view of the connector 72 of the connection assembly 70, taken along section line 4—4 of FIG. 3. The connector 72 includes a nonconductive plate, preferably provided by the printed circuit board 74. The circuit board 74 has guide holes 75. The guide holes 75 in the board 74 provide bearing surfaces through which the plungers 98 slidably extend, and by which the plungers 98 are guided in to extend in parallel directions for engaging the moveable cam member 102. The housing 92 is formed such that retaining shoulders are provided to retain the moveable contact member within the housing 92, such that the moveable contact member will not pass through the aperture 94. The housing 104 is preferably formed of a nonconductive material, and includes a plurality of bores 105, preferably provided by blind holes. Bias members, preferably coil springs 100, are disposed in the bores 105. The plungers 98 have enlarged heads 103 which are entrapped within the bores 105 by the size of the guide holes 75 in the circuit board 74 being smaller than that of the heads 103. The bias springs 100 urge the plungers 98 into extended positions pushing the moveable cam member 102 into an extended position, which increases the spacing between opposing pairs of the leads 96.

The moveable cam member 102 is preferably continuous and extends the full length of the connector 72, but in other embodiments may be provided in sections. Preferably, the moveable cam member 102 is of a length such that a selectable number of the bias springs 100 may be removed in order to reduce the force required to push the moveable cam member rearward during makeup of the connector 22 of the UUT 20 with the connector 72, thereby selecting the insertion force required for makeup. In some embodiments, the bores 105 may extend through the housing 104 and then the ends thereof may be threaded for receipt of a threaded plug member to allow for removable of the bias springs 100 without requiring disassembly of the connector 72. In the alternative, removable blanking member, such as a small rod or flat plate, may be provided which fits flush with a surface of the housing 104 such that the connector 72 will have a more compact profile than if threaded blanking plugs are used to retain the springs 100 within the bores 105. Preferably, the bores 105 are blind holes and the housing 104 is removed from the circuit board 74 for installation and removal of the selectable number of springs 100 from within the bores 105 to determine the insertion force required for makeup of a mating connector with the connector 72.

Figure 5:
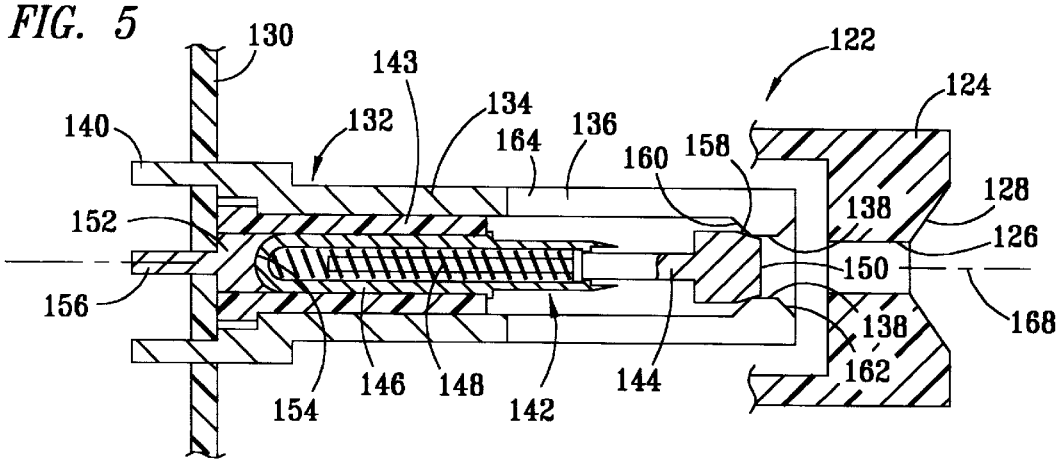
FIG. 5 is a longitudinal sectional view of a contact assembly of a low insertion force connector of a first alternative embodiment to the contact assemblies used in the connector of FIG. 3, as would be viewed from the rear of the sectioning plane taken along section line 3—3 of FIG. 1 when used in the adapter unit for connecting a unit under test to the test station.

FIG. 5 is a longitudinal sectional view of a collet-type contact assembly 122, such as may be used as a first alternative embodiment for the contact assemblies of the connector 72, as would be viewed from the rear of a sectioning plane taken along section line 3—3 of FIG. 1 when used in place of the contact assemblies of the connector 72. The embodiment shown for the contact assembly 122 may be sized for accommodating 0.025 inch square or round mating contact leads on 0.100 inch centers. The contact assembly 122 includes an enclosure 124 having an aperture 126. The aperture 126 includes a tapered guide portion 128 for guiding mating contacts through the aperture 126 and into the interior of the enclosure 124 in alignment for mating with the contact assembly 122. The tapered guide portion 128 is preferably coaxial with and concentric with the aperture 126. The enclosure 124 is mounted to a printed circuit board 130. The contact assembly 122 further includes a collet-type contact 132. The collet contact 132 has a continuous, solid rear body portion 134 and a forward body portion having slots 164 which define collet fingers 136. The slots 164 and the collet fingers 136 extend parallel to a longitudinal axis 168 of the collet contact 132. The inward facing portions of the collet fingers 136 define two pairs of oppositely disposed, inwardly facing collet contact faces 138. The rearward end of the solid, continuous, rear body portion 134 of the collet contact 132 defines a contact connection 140.

The contact assembly 122 further includes a spring biased pin assembly 142. An insulator 143 separates the pin assembly 142 from the rear body portion 134 of the collet contact 132. The spring biased pin assembly 142 includes a plunger 144 which is slidably mounted within a sleeve 146. A bias spring 148 urges the plunger 144 into an extended position from within the sleeve 146. The plunger, the sleeve 146 and the spring 148 are preferably formed of metal. The forward end of the plunger 144 defines a contact face 150. The contact assembly 122 further includes a socket contact 152, having a contact face 154 for engaging the rearward end of the pin assembly 142. A contact connection 156 is defined on the rearward end of the socket contact 152. The forward end of the plunger 144 has a periphery which defines a cam surface 158 for engaging a mating surface 160 defined on an interior portion of the periphery of the collet fingers 136. The forward end of the collet fingers 136 provide guide surfaces 162 which provide a tapered entrance hole.

Figure 6:
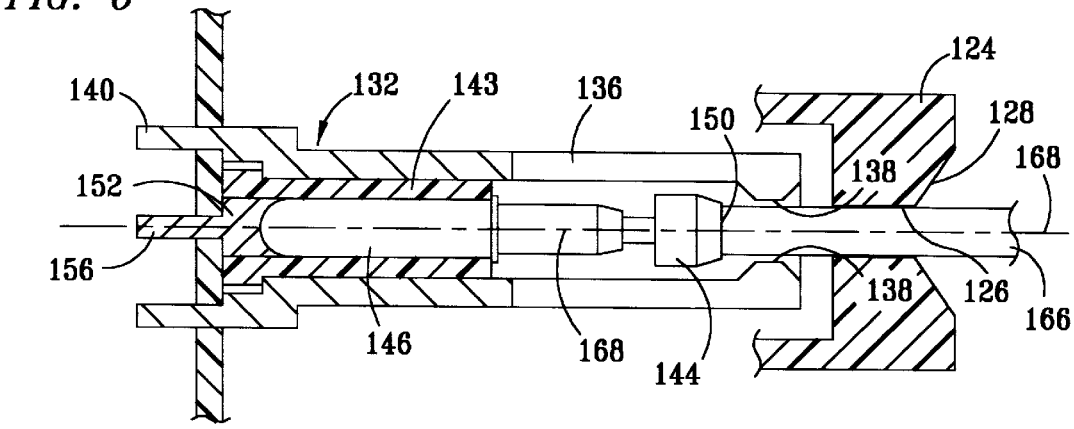
FIG. 6 is a partial section view of the contact assembly of FIG. 5, after being mated with a contact of a mating connector.

FIG. 6 is a partial section view of the collet-type contact assembly 122 of FIG. 5, after a mating contact 166 has been inserted and engaged with the contact assembly 122. The plunger 144 has been pushed inward within the sleeve 146 to a retracted position and the face 150 of the plunger 144 engages the forward end of the mating contact 166. Movement of the plunger 144 rearward and into the sleeve 146 will allow the collet fingers 136 to move inward toward the longitudinal access 168 of the collet contact 132, such that the collet contact 140 will engage the exterior surface of the mating contact 166. Preferably, the shape of the cam surface 158 and the mating surface 160 is formed such that the contact surface 140 of the collet fingers 136 will engage the exterior of the mating contact 166 in a scraping engagement to wipe the surfaces of the contacts 136 and 166 clean for an insertion travel of approximately thirty thousandths of an inch (0.030 inches) as the mating contact 166 is inserted within the collet contact 132. The insulator 143 separates the collet 132 from the sleeve 146 of the pin assembly 142 to provide two separate circuit paths to the mating contact 166.

Figure 7:
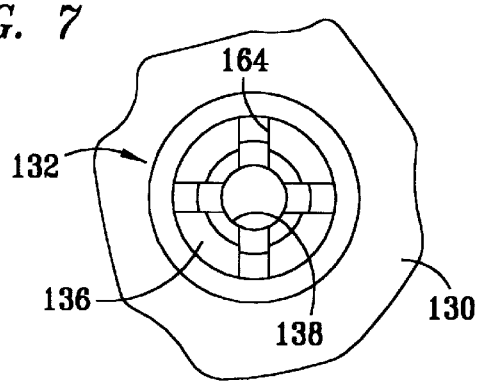
FIG. 7 is an end view of the contact assembly of FIG. 5.

FIG. 7 is an elevation view of the forward end of the collet contact 132. Slots 164 are shown extending into the forward end of the collet contact 132, defining the collet fingers 136. The contact surfaces 128 are arcuately shaped.

Figure 8:
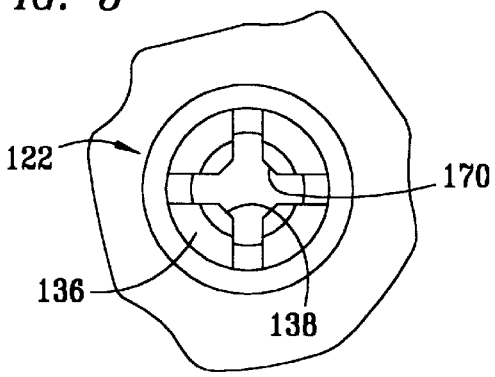
FIGS. 8, 9 and 10 are end views of alternative embodiments of the contact assembly of FIGS. 5 and 6.

FIG. 8 is an elevation view of the forward end of the collet contacts 132, showing flat contact surfaces 138 for the collet fingers 136.

Figure 9:
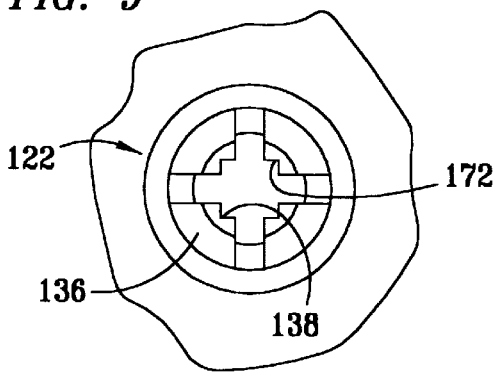

FIG. 9 is an elevation view of the forward end of the collet contact 132. Notches 172 are formed into the contact faces 138. The notches 172 have square profiles. The contact face 138 of the collet fingers 136 are shown having notches 172 formed therein. The notches 172 are preferably formed with sides at substantially right angles, and the notches 172 are aligned such that they together define a square profile for mating with a mating contact 166 having a square-shaped cross section.

Figure 10:
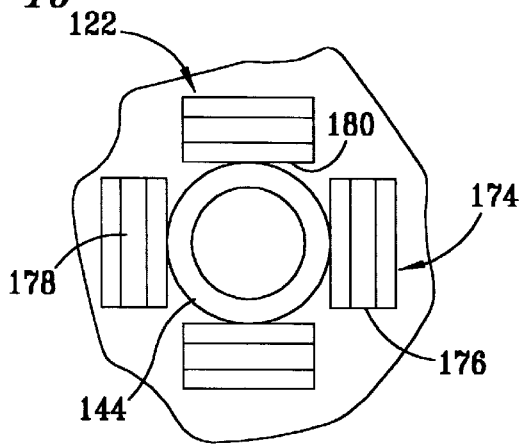

FIG. 10 is an elevation view of the forward end of the contact 132, showing an alternate embodiment in which an alternative contact member 174 is used having a square-shaped cross section, rather than a cylindrical shaped cross-section. The contact member 174 may be formed of a tubing having a square-shaped cross section. The forward end of the contact member 174 has four slots 176 cut therein to define contact fingers 178. The contact fingers 178 preferably have inwardly facing contact faces 180 which are preferably aligned for receiving a mating contact 166 having a square-shaped cross section. The plunger 144 may have a cylindrical-shaped cross section. In other embodiments, a piston of square-shaped cross section may be used.

Figure 11:
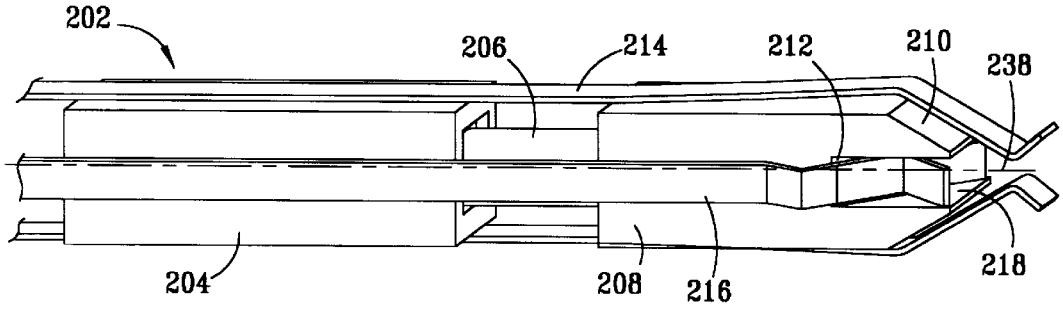
FIG. 11 is a perspective view of a contact assembly of a second alternative low insertion force connector of the present invention, shown prior to mating with a contact of a mating connector.

FIG. 11 is a perspective view of a contact assembly 202 of a second alternative low insertion force connector, preferably for engaging 0.025 inch square leads on 0.300 inch centers, and having leaf-spring type contact members 214 and 216. The contact assembly 202 includes a boss 204, preferably having a rectangular-shaped cross-section, or a square-shaped cross section. A guide member 206 is rigidly mounted to the boss 204 and extends forward of the boss 204. A movable cam member 208 is slidably engageable upon the guide member 206. The movable cam member 208 includes cam surfaces 210 and 212, which are angularly spaced apart equal angular distances around a longitudinal axis 238 of the contact assembly 202. The forward cam surfaces 210 are disposed on the forwardmost end of the moveable cam member 208, on opposite sides from one another. The cam surfaces 212 are spaced rearward from the forward end of the moveable cam member 208, and disposed on opposite sides from one another, and rotated 90 degrees from the cam surfaces 210 in a plane which is transverse to the longitudinal axis 238 of the contact assembly 202. The contact assembly 202 has two leaf-spring type contacts 214 and two leaf-spring type contacts 216 which are angularly spaced apart equal distances and extend parallel to the longitudinal axis 238 of the contact assembly 202. The contacts 214 are preferably longer than the contacts 216, and aligned for fitting against respective ones of the cam surfaces 210. A slot 218 is formed in the forward end of the moveable cam member 208 for receiving the two contacts 216 in alignment for engagement with respective ones of the cam surfaces 212. The moveable cam member 208 is shown in FIG. 11 as being extended in a forward position, such that the corresponding ones of the contacts 214 and 216 are spaced apart by engagement with respective ones of the cam surfaces 210 and 212. The boss 204 and the moveable cam member 208 are preferably formed of nonconductive materials to isolate the contacts 214 and 216 from one another, such that four separate circuit paths are provided. In other embodiments, insulation layers may be provided to insulate the contacts 214 or 216 from one another.

Figure 12:
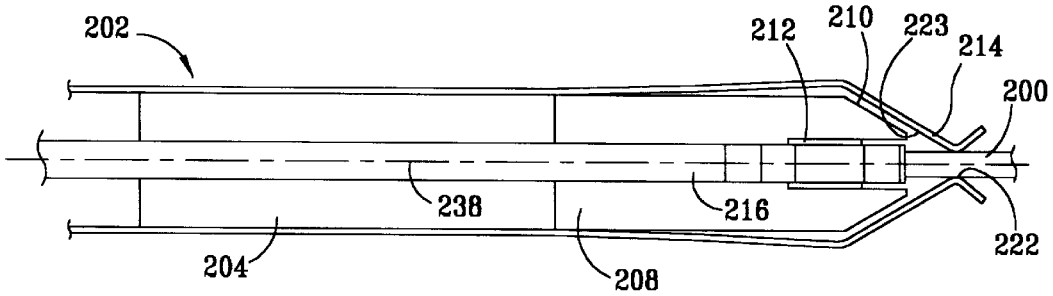
FIG. 12 is a side elevation view of the second alternative contact assembly, after being mated with a mating contact.

FIG. 12 is a side elevation view of the contact assembly 202 after the moveable cam member 208 has been pushed rearward by a mating contact 200 of a mating connector. The cam surfaces 210 and 212 have been moved beneath respective ones of mating surfaces 223 of the contacts 214 and 216, such that the contacts 214 and 216 will be urged inward and engage the outer periphery of the mating contact 200. Preferably, the geometrical relationships of the contact surfaces 222 and the shape of the mating surfaces 223 of the cam surfaces 214 and 216 is such that the contact surfaces 222 of the contacts 214 and 216 will scrape or wipe the outer periphery of the mating contact 200 for approximately thirty thousandths of an inch (0.030 in.). The forward end of the boss 204 preferably provides a stop for preventing further rearward movement of the moveable cam member 208 when the mating contact 200 is being engaged therewith. The contacts 214 and 216 thus provide four separate circuit paths to the mating contact 200.

Figure 13:
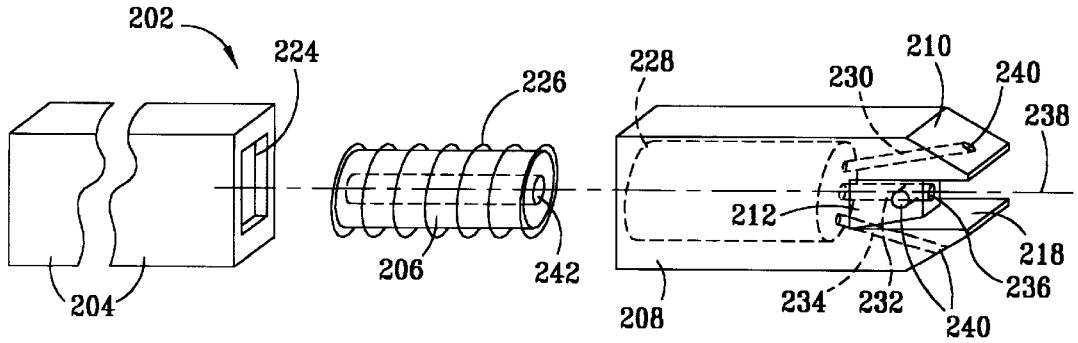
FIG. 13 is an exploded, perspective view of the second alternative contact assembly.

FIG. 13 is an exploded view of the contact assembly 202. Preferably, a recess 224 is formed in the forward end of the boss 204. The boss 204 preferably has a rectangular cross section. The guide member 206 is preferably cylindrical in shape and mounts within the recess 224. A bias spring 226 extends exteriorly around the guide member 206. A recess 228 is formed in the rearward end of the moveable cam member 208 for receiving the guide member 206 and the bias spring 226 in a sliding engagement.

The contact assembly of FIG. 13 further includes a cleaning flow ports 236 for cleaning the mating contacts, and cleaning flow ports 240 for cleaning the contact 214 and 216 with a discharge of cleaning fluid, such as solvent, air, a combination of solvent and air, or the like. Flow passages 230, 232 and 234 connect with the recess 228 and extend through exterior surfaces of the moveable cam member 208 to define respective ones of the flow ports 236 and 240. A flow passage 242 extends through the guide member 206 and into the boss 204 for connecting the recess 228 to a supply of solvent, air, or the like. A seal member, such as an O-ring, a chevron-shaped seal or lip seal, may be used to seal between the guide member 206 and the recess 226.

Alternatively, a small leakage of cleaning fluids may be tolerated from the space between the guide member 206 and the recess 226. The recess 226 is pressurized to spray a discharge of cleaning fluid through the flow ports 238 and 240.

Figure 14:
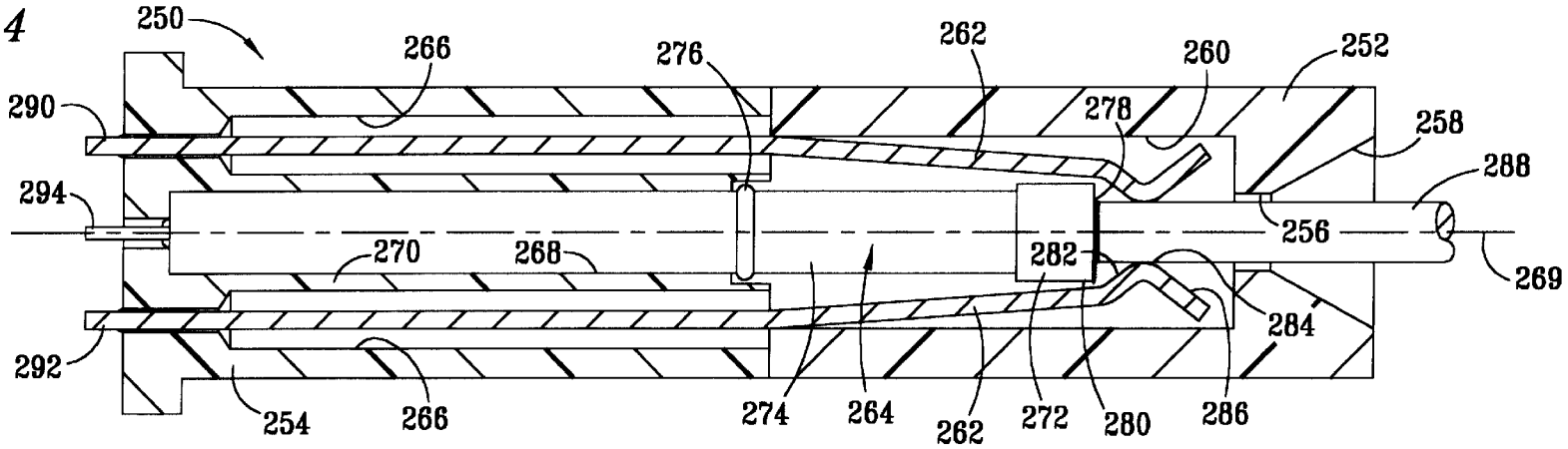
FIG. 14 is a sectional view of a third alternative contact assembly for a connector of the present invention, having leaf-spring type contacts and a contact plunger which is spring biased.

FIG. 14 is a sectional view of a contact assembly 250 of a third alternative low insertion force connector. The contact assembly 250 is for engaging a mating contact 288, which is preferably one of 14.0 gauge leads on 0.200 inch centers, and applying a 30.0 amp drive current to the mating contact 288. The contact assembly 250 includes a connector housing having a forward housing 252 and a rearward housing 254 which are fastened together. The forward housing 252 includes a forwardly disposed aperture 256 having a tapered guide surface 258. The aperture 256 extends into an interior cavity 260, which is formed into the interior of the forward housing 252. Two contact leads 262 extend within the interior cavity 260 on opposite sides of a contact pin assembly 264. Two bores 266 are formed on opposite sides of the rearward housing 254 for receiving the contact leads 262. A central bore 268 is formed within a central interior portion of the rearward housing 254, preferably concentric with a central longitudinal axis 269 of the contact assembly 250. A cylindrical insulator portion 270 is defined by the portion of the rearward housing 254 which extends between respective ones of the two bores 266 and the central bore 268. A fastener 296 secures the forward housing 252 to the rearward housing 254. Preferably, the forward and rearward housings 252 and 254 are formed from a non-conductive material, such as a plastic.

A contact pin assembly 264 preferably includes a plunger or a cam member 272 and a sleeve 274. Preferably the plunger 272 is spring biased to extend forwardly of and from within the sleeve 274. A bias member 148, which is preferably is a coil spring, is mounted within the sleeve 274 to bias the plunger 272 outward from within the sleeve 274, as shown for the contact pin assembly 122 of FIG. 5. A stop 276 extends outwardly of the sleeve 274 for engaging a forward end of the central bore 268. The forward end of the plunger 272 has a contact face 278. The forward periphery of the plunger 272 defines a cam surface 280. The forward ends of the contact leads 262 are preferably formed to define mating surfaces 282 for engaging the cam surface 280, contact surfaces 284 for engaging a mating contact 288, and guide surfaces 286 for guiding the mating contact 288 to extend between opposing ones of the contact leads 262. Preferably, the contact leads 262 are flat, leaf-spring type contacts, such as those having a rectangular cross section. The mating contact 288 extends through the aperture 256 of the forward housing 252, and engages the contact face 278 of the piston 272. Movement of the mating contact 288 further into the forward housing 252 pushes the piston 272 back into the sleeve 274 until the cam surface 280 of the piston 272 is moved from between the mating surfaces 282 of the oppositely disposed contact leads 262, allowing the contact surfaces 284 of the contact leads 262 to engage upon the forward end of the mating contact 288. Preferably, the mating contact 288 will move for another thirty thousandths of an inch (0.030 in.) between the contact surfaces 284, and the mating contact surface is wiped. Then, the forward face of mating contact 288 will be engaged by the contact face 278 of the piston 272, and the outer periphery of the mating contact 288 will be engaged by the two contact surfaces 284 of the contact leads 262. Electrical connections 290 and 292 are provided for respective ones of the contact leads 262. A contact 294 is electrically coupled to the contact pin 264.

Figure 15:
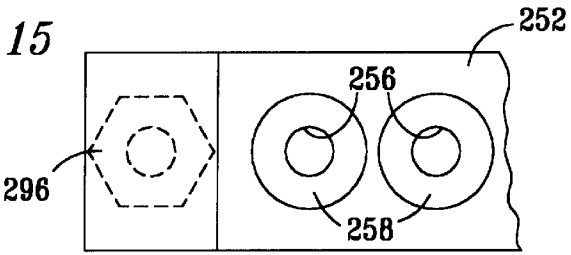
FIG. 15 is a front elevation view of a housing of the third alternative contact assembly.

FIG. 15 is an elevation view of the forward end 252 of the connector housing, showing apertures 256 and the tapered guide surfaces 258. Two of the apertures 256 are shown.

Figure 16:
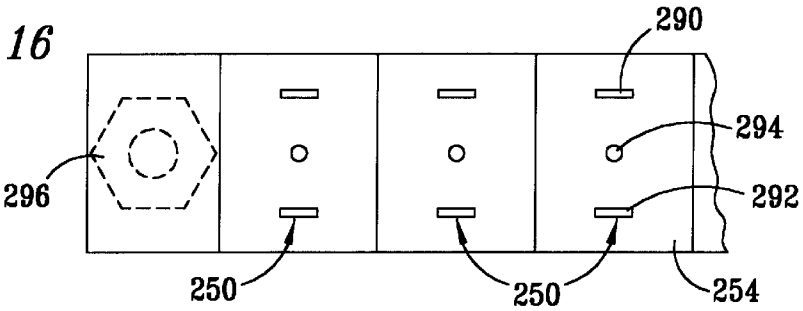
FIG. 16 is a rear elevation view of the housing of the third alternative contact assembly.

FIG. 16 is an elevation view of the rear housing 254 of the connector housing of the contact assembly 250. The contact 294 of the rear contact connections is shown. The rearward end of respective ones of the contact leads 262 are shown as the connections 290 and 292.

Figure 17:
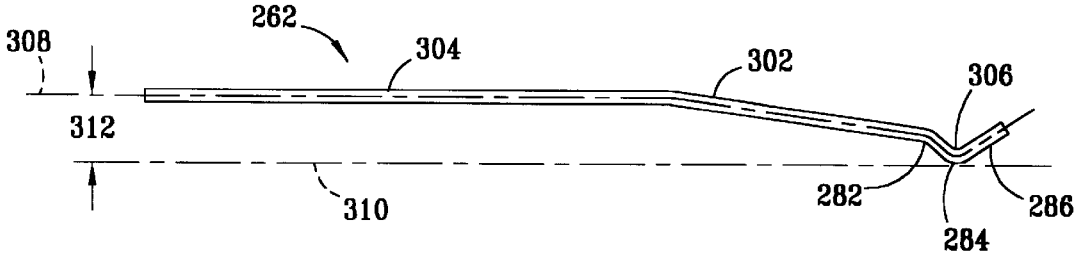
FIG. 17 is a side elevation view of a leaf-spring type contact for use in the third alternative contact assembly.

FIG. 17 is a side elevation view of one of the contact leads 262. The contact lead 262 preferably has a biasing portion 302, and a forwardly disposed contact portion 306. A mounting portion 304 is disposed rearward of the biasing portion 302. The forward end of the contact portion 306 is formed to define a mating surface 282 for engaging the cam surface 280 of the piston 272. Also formed on the contact portion 306 is the contact surface 284 and the guide surface 286. The guide surface 286 is forward of the contact surface 284. The contact member 262 has a central longitudinal axis 308 which on a rearward end is spaced apart from a line 310. The rearward end of the axis 308 of the contact 262 is spaced apart a distance 312 of 0.090 inches from the line 310 and the contact portion 284 touches the line 310. Preferably, the contact lead 262 is formed of a spring steel, or of another resilient material, that will provide a spring force or biasing force for engaging the contact surface 284 against a mating contact lead with a wiping engagement therebetween.

Figure 18:
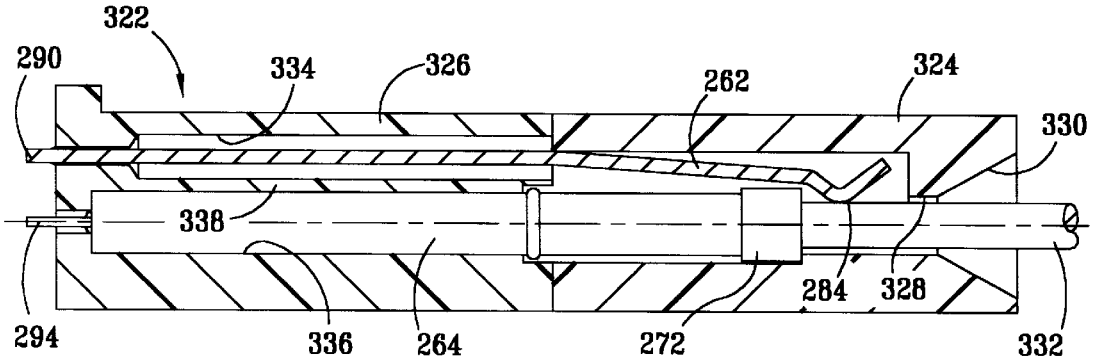
FIG. 18 is a fourth alternative contact connector having a single test contact and a single power contact for each of the contacts of a mating connector.

FIG. 18 is a longitudinal sectional view of a contact assembly 322 of a fourth alternative connector, preferably sized for connecting to 14.0 gauge leads aligned in rows on 0.200 inch centers, with the rows also being spaced apart on 0.200 centers, and applying a 30.0 amp drive current through the plunger 272 of the contact pin assembly 264 to a mating contact 332. A contact lead 262 is used for measuring the voltage applied to the mating contact 332. The plunger 272, the contact pin assembly 264 and the contact lead 262 are similar to those shown above and described for FIGS. 14 and 17. The contact assembly 322 has a forward housing 324 and a rearward housing 326. An aperture 328 is formed in the forward portion of the rearward housing 326 and includes a tapered entrance guide portion 330. The mating contact 332 extends through the aperture 328 for engaging the plunger 272 of the contact pin assembly 264 and the contact lead 262. A bore 334 is provided for receiving the contact lead 262, and a bore 336 is provided for receiving the contact pin assembly 264. An insulator portion 338 extends between the bore 334 and the bore 336. Preferably, the rearward housing 326 and the forward housing 324 are formed from an insulating material, such as a plastic. The contacts 290 and 294 will extend at the rearward end of the rearward housing 326.

Figure 19:
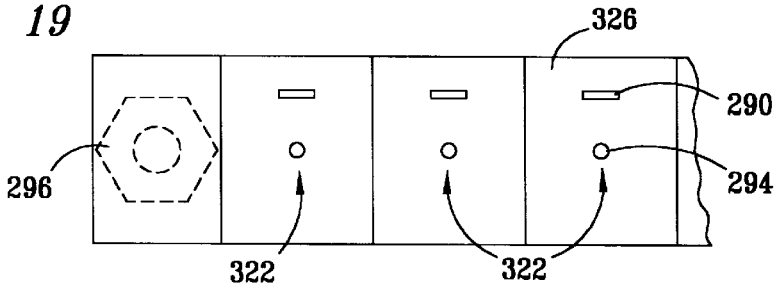
FIG. 19 is a rear elevation view of the fourth alternative connector having a single test contact and a single power contact.

FIG. 19 is an elevation view of the rearward end of the rearward housing 326, showing the contacts 290 and 294 extending rearwardly therefrom. Preferably, the contact 294 is soldered, or braised, to the rearward end of the contact pin assembly 264. The contact 290 is preferably the rearwardly end portion of the contact lead 262.

Figure 20:
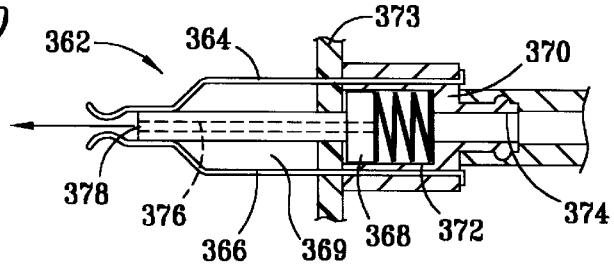
FIG. 20 is a sectional view of an alternative low insertion force contact assembly of a fifth alternative embodiment, having a cleaning port for discharging a cleaning fluid to clean the contacts.

FIG. 20 is a sectional view of an alternative low insertion force contact assembly 362 of a fifth alternative embodiment. The contact assembly has contacts 364 and 366 for engaging a mating lead. A plunger 368 provides a moveable cam member and may be formed of a nonconductive material, such as plastic, or formed of a conductive material to provide a contact for engaging a mating contact of a mating unit. If the plunger 368 is formed of a conductive member, than insulator layer 369 may be provided by an air gap, as shown, or by an insulator member, or the like, which separates the contacts 364 and 366 from the plunger 368, as shown for the embodiments of FIGS. 5, 14 and 18. Alternatively, the plunger 368 may be formed of a nonconductive material, and have a conductor which extends interiorly therein for connecting to a mating lead, or a combination of the above. A housing 370 includes a bore 372 for enclosing a head portion of the plunger 368. The housing 370 is mounted to a plate 373, preferably provided by a printed circuit board 373. A flow passage 374 extends through the housing 370 and into the bore 372. A flow passage 376 extends through the length of the plunger 368 to define a flow port 378 on the outward end of the plunger 368. A spray of a pressurized solvent, a blast of air, or a combination thereof, may be passed through the passages 374 and 376 for discharge through the flow port 378 to clean the end of a mating contact. Additionally, the spray of solvent, air, or the like, may be directed from the cleaning port 378 in directions for cleaning the mating contact surfaces of the contacts 364 and 366, or additional flow port may be provided which are similar to the flow ports 236 and 240 for the moveable member 208 of FIG. 13.

Figure 21:
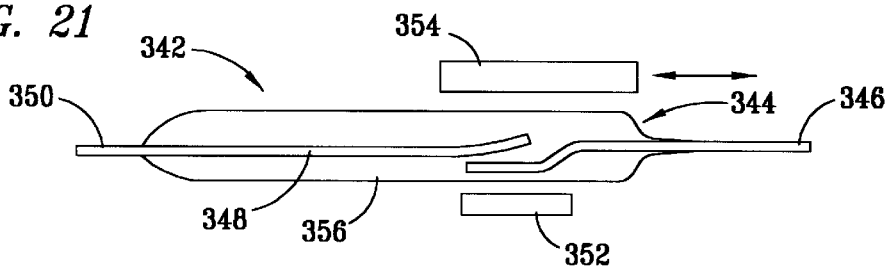
FIG. 21 is a schematic view of a safety switch for use in a test station.

FIG. 21 is a schematic diagram of a reed switch 342 which may be used for the reed switch 86 of the safety switch 84 shown in FIGS. 1 and 2. The reed switch 342 includes a stationary contact 346, a moveable contact element 348 and a contact portion 350 of the contact 348. A housing 356 encloses the mating portions of the contacts 346 and 348. Preferably, a magnet 352 is rigidly secured to the housing 356 to bias the reed contact 348 to engage the contact 346, which preferably shunts the power circuit of the adaptor unit 16 to ground. A permanent magnet 354 may be used for the magnetic actuator 86 of FIGS. 1 and 2. When the drawer 28 is fully within the enclosure 16 and the cover 30 fully covers the opening 32, the magnet 354 will be aligned adjacent to the switch 344, overcoming the bias of the magnet 352 and pulling the reed contact 348 away from the contact 346, such that the power circuit of the adaptor 16 is no longer shunted to ground. Power may then be applied to test the circuitry of the UUT 20.

The present invention provides several advantages over the prior art. A low insertion force connector is provided which includes connector assemblies having separate circuit paths for connecting to a single mating contact of a mating connector. The two circuit paths have first and second contacts, respectively, which engage the mating contact at separate engagement points. An insulator extends between the first and second contacts, insulating at least rearward portions of the first and second contacts from one another. The first contact preferably has a cam surface and is moveable from an extended position to a retracted position. In the extended position, the cam surface pushes the second contact aside of a position for engaging the mating contact. Engagement of the mating connector with the low insertion force connector pushes the mating contact against the first contact, which moves the first contact from the extended position to the retraced position. When the first contact is disposed in the retracted position, the second contact engages the mating contact, and wipes the mating contact during a later portion of an insertion stroke for engaging the mating contact with the first and second contact. Mating leads may also be cleaned of contaminates with a spray of solvent or a blast of air when being mated to a contact assembly.

Although the preferred embodiment has been described in detail, it should be understood that various changes, substitutions and alterations can be made therein without departing from the spirit and scope of the invention as defined by the appended claims.

What is claimed is:

1. An apparatus suitable for connecting to an electrical contact lead of a mating unit, said contact lead having an end portion and a side portion, said apparatus comprising:

a housing having an aperture for receiving said contact lead; said aperture providing an opening to a path into said housing to receive said contact lead;

a contact pin assembly comprising a sleeve and a moveable, electrically conductive cam member; said pin assembly positioned in said housing and said cam member being capable of moving reciprocally from an extended position near said aperture to a retracted position away from said aperture;

said contact pin assembly electrically connected to a first electrical connecting means for electrically connecting to an external device;

first bias member positioned within said sleeve and operable to urge said cam member towards said aperture; and contact means located in said housing and comprising an electrical connection portion for being electrically connected to said contact lead, and a second bias member urging said electrical connection portion generally into said path for said contact lead;

said electrical connection portion including a second electrical connection means for electrically connecting to another external device;

said cam member being shaped so that it moves said electrical connection portion out of said path for said contact lead when said cam member is in its extended position and said cam member allowing said electrical connection portion to be moved towards said path by said second bias member when said cam member is moved into its retracted position;

said first and second electrical connection means being electrically insulated from each other when said cam member is in its retracted position.

2. The apparatus as claimed in claim 1, further comprising said cam member and a portion of the interior of said housing being designed to engage each other when said cam member is moved towards its retracted position, thereby providing a stop feature to inhibit further motion of said cam member away from said aperture.

3. The apparatus as claimed in claim 2, wherein said apparatus is dimensioned so that said electrical connection portion engages said cam member a predetermined distance before the stop feature inhibits further motion of said cam member away from said aperture, thereby defining a wipe of the electrical connection portion.

4. The apparatus as claimed in claim 3, wherein said apparatus has a wipe length along said contact lead no more than about thirty thousands of an inch.

5. The apparatus as claimed in claim 1, wherein said contact means comprises a leaf-spring metal to form said second bias member.

6. A method for connecting to an electrical contact lead of a mating unit, said contact lead having an end portion and a side portion, said method comprising:

providing a housing having an aperture for receiving said contact lead; said aperture providing an opening to a path into said housing to receive said contact lead;

mechanically arranging a contact pin assembly comprising a sleeve and an electrically conductive cam member; said contact pin assembly positioned in said housing and said cam member being capable of moving reciprocally from an extended position near said aperture to a retracted position away from said aperture;

said contact pin assembly electrically connecting to a first electrical connecting means for electrically connecting to an external device;

positioning within said sleeve a first bias member operable to urge said cam member towards said aperture;

locating in said housing a contact means comprising an electrical connection portion for being electrically connected to said contact lead, and a second bias member urging said electrical connection portion generally into said path for said contact lead; and said electrical connection portion including a second electrical connection means for electrically connecting to another external device;

said cam member being shaped so that it moves said electrical connection portion out of said path for said contact lead when said cam member is in its extended position and said cam member allowing said electrical connection portion to be moved towards said path by said second bias member when said cam member is moved into its retracted position;

said first and second electrical connection means being electrically insulated from each other when said cam member is in its retracted position; and moving said contact lead into said aperture to move said cam member to said retracted position resulting in said electrical connection portion electrically engaging said end portion.

* * * * *